US005461962A

United States Patent [19]

Krumm et al.

[11] Patent Number: 5,461,962

[45] Date of Patent: Oct. 31, 1995

[54] GUN SILENCER ARRANGEMENT

[75] Inventors: Herbert Krumm, Kaarst; Karl Wiemers, Bochum, both of Germany

[73] Assignee: Rheinmetall GmbH, Ratigen, Germany

[21] Appl. No.: 250,844

[22] Filed: May 27, 1994

[30] Foreign Application Priority Data

May 27, 1993 [DE] Germany ..... 43 17 673.9

[51] Int. Cl.[6] ..... F41A 21/30

[52] U.S. Cl. ..... 89/14.4; 181/223

[58] Field of Search ..... 73/167; 89/14.4; 181/223

[56] References Cited

U.S. PATENT DOCUMENTS 3,713,262 1/1973 Charron ..... 89/14.4
4,576,083 3/1986 Seberger, Jr. ..... 89/14.4

FOREIGN PATENT DOCUMENTS 430499 8/1967 Switzerland .
679946 5/1992 Switzerland ..... 181/223
666249 2/1952 United Kingdom .

OTHER PUBLICATIONS

The Washington Post and Times Herald, "Navy Can Silence a Howitzer", Oct. 19, 1957, p. A3.

*Primary Examiner*—Stephen C. Bentley
*Attorney, Agent, or Firm*—Spencer, Frank & Schneider

[57] ABSTRACT

A silencer arrangement for large-caliber guns (3;33,34) including at least one silencer (5;54,55). In order for the system characteristics of the gun (3;33,34) not to be negatively influenced by the heavy weight of the silencer (5;54, 55), the silencer is not fastened (5;54,55), as in the case of small-caliber weapons, on the weapon tube or barrel itself, but instead, is arranged on a separate silencer gun carriage (6;39) which is mechanically decoupled from the gun (3;33, 34), with the gun carriage (6;39) preferably being configured such that the silencers (5;54,55) may be moved in synchronism with the movement of the gun barrel.

9 Claims, 3 Drawing Sheets

GUN SILENCER ARRANGEMENT

CROSS-REFERENCE TO RELATED APPLICATIONS

This application claims the priority of German Patent application No. P 43 17 673.9 filed May 27, 1993, which is incorporated herein by reference.

BACKGROUND OF THE INVENTION

The invention relates to a silencer arrangement for guns, including at least one silencer.

The configuration and function of gun silencers, particularly for small arms and hand guns, are disclosed, for example, in U.S. Pat. No. 3,713,362 and U.S. Pat. No. 4,576,083. This type of silencer is usually screwed to the muzzle of the gun tube or barrel.

The arrangement of known silencers on the muzzle of the tubes or barrels of large-caliber weapon systems (combat tanks, armored personnel carriers, anti-aircraft tanks or artillery systems) has not proven to be successful in practice. This is generally because, due to the large caliber of the weapons and the development of related noises, the silencers for such large caliber weapons must also be dimensioned suitably large and, as a consequence, are massive. However, the system characteristics of the weapon arrangement, particularly the stabilizing and alignment arrangements are influenced in a particularly unacceptable manner.

There was no shortage of tests for developing light-weight silencers for large-caliber weapons. However, besides being relatively costly, this type of silencer remains so massive that it cannot be employed in practice for the above-mentioned reasons. As far as the applicant knows, this is the reason why no silencers are currently used in large-caliber gun systems. However, especially during firing exercises on suitable firing sites, this increasingly results in problems which are due to the high emission of noise.

It is thus the object of the present invention to provide a silencer arrangement for large-caliber weapon systems in which the system characteristics of the gun are not negatively influenced by the heavy weight of the silencer and which makes possible an operation appropriate to the exercise, especially at firing sites.

SUMMARY OF THE INVENTION

The above object generally is attained according to one aspect of the present invention by a silencer arrangement for at least one gun which comprises: at least one silencer for enclosing a muzzle of a gun barrel; a silencer gun carriage on which the at least ones silencer is mounted, with the silencer gun carriage being mechanically decoupled from the gun with which the at least one silencer is to be used; and means, including adjustment members mounted on the silencer gun carriage, for adjusting the elevation and azimuth positions of the silencer such that when a gun is in a firing position relative to the silencer gun carriage, the gun bore axis and a central axis through the silencer are aligned.

According to a further aspect of the invention, the above object is achieved according to the present invention by a silencer arrangement for a gun including at least one silencer for enclosing a muzzle end of a gun barrel, and a silencer gun carriage which is mechanically decoupled from the gun, with the silencer gun carriage comprising: two mounting columns which are arranged vertically parallel to one another, and whose distance from one another is greater than the width of the gun mount which is to be arranged between the columns and whose gun is to be provided with the silencer, and with the mounting columns being mounted for pivotal or rotational movement about their respective vertical longitudinal axes; a respective extension arm mounted, at a predetermined height, on each mounting column for rotation about a common horizontal axis of rotation; at least one controllable drive member for rotating the two extension arms about the horizontal axis of rotation; a transverse member connected between respective ends of the two extension arms facing away from the mounting columns via hinge joints; and further hinge joints for connecting the at least one silencer to the transverse member between the two extension arms.

Further particularly advantageous modifications of the invention likewise are disclosed.

The invention is thus essentially based on the concept of fastening the respective silencer, not, as is the case with small-caliber weapons, on the gun tube or barrel itself, but instead to arrange it on a separate silencer gun carriage which is mechanically decoupled from the weapon tube, with the gun carrier preferably being constructed such that the silencer can be guided in synchronism with the movement of the weapon tube or barrel.

Further details and advantages of the invention are apparent from the specification below and are elucidated by the embodiments shown in the figures.

DETAILED DESCRIPTION OF THE PREFERRED EMBODIMENTS

Figure 1:
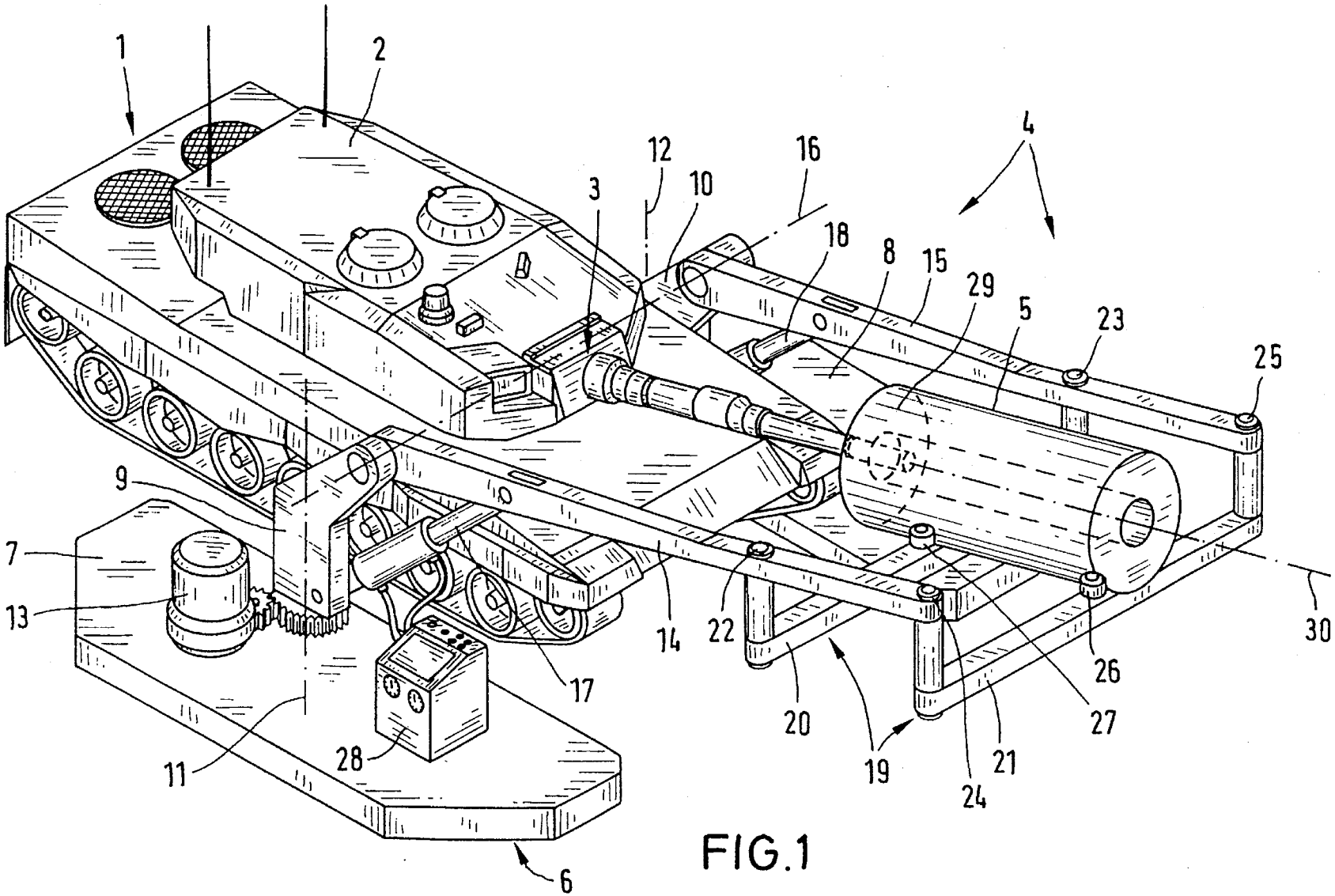
FIG. 1 is a perspective view of a first embodiment of the silencer arrangement according to the invention, including a combat tank in the firing position.

In FIG. 1, reference numeral 1 refers to a combat tank in its firing position. The tank 1 includes a rotatable turret 2 and a large-caliber gun 3. On the outside of the rotational range of the tank turret 2 is a silencer arrangement 4 which essentially comprises a silencer 5 and a gun carriage 6 supporting the silencer.

The silencer gun carriage 6 is provided with two base plates 7 and 8 on which respective parallel mounting columns 9 and 10 are arranged for rotation (pivoting) about their vertical respective longitudinal axes 11 and 12. The pivoting or rotational movements in this case are effected by adjustment members (drives) which are coupled to the mounting columns 9 and 10, with FIG. 1 merely showing one such drive denoted by 13 coupled to column 9 via appropriate gears. The horizontal distance of the two mounting columns 9 and 10 from one another is greater than the width of the tank 1, so that the latter can partly move into the gun carriage 6.

Attached to the upper end of each mounting column 9, 10 of the gun carriage 6, i.e., the end facing away from the respective base plate 7, 8, is a respective extension arm 14 or 15. Both extension arms 14, 15 are pivotal about a common horizontal rotational axis 16 which, in the embodiment shown in FIG. 1 with the tank 1 in the firing position, also corresponds to the trunnion axis of the gun 3. This association of the gun 3 and the silencer gun carriage 6 may be accomplished by a movement of the tank 1 or by adjustment of an adjustment device on the mounting columns 9, 10 of the gun carriage 6.

The pivoting movement of the extension arm 14, 15 about the horizontal axis 16 is effected by the respective adjustment members 17, 18, which may also be, for example, hydraulic, electric or even mechanical adjustment members.

The respective ends of the two extension arms 14, 15 facing away from the mounting columns 9, 10, are joined by hinges or bearings 22, 24 and 23, 25 to a transverse member 19. The transverse member 19 essentially comprises two parallel cross-ties 20, 21, to which the silencer 5 is also fastened by further bearings or hinge joints 27 and 26, respectfully. Transverse member 19 together with cross ties 20, 21 and hinge or bearing joints 22–27 form a parallel crank mechanism.

An evaluation unit 28 is provided in a control panel on base plate 7. The evaluation unit 28 is connected , on the one hand, with sensors 29 at the front of the silencer 5 and, on the other hand, with adjustment members or drives 13 and 17, 18. As a result, the center position of the gun muzzle of the weapon 3 is thus checked by the sensors 29, and the adjustment members 13, 17 and 18 are controlled and actuated by way of the evaluation unit 28 to provide the proper alignment between the bore axis of the barrel of the gun 3 and the central axis 30 through the silencer 5.

Moreover, the directional or aiming signals of the directional control or aiming devices for the gun 3, which are not shown in order to provide a clearer overview, may be scanned, for example, by means of a test plug connection to the gun control device, and used for the primary control of the silencer gun carriage 6. However, in order to increase operation safety or reliability, the position of the gun in relation to the silencer 5 is also tested or monitored via the above-mentioned sensors 29 and, if indicated, corrected.

During height or elevation adjustment of the gun 3, the adjustment members 17, 18 are actuated, either on the basis of the measured sensor signals or on the basis of the aiming signals that are present at the test plug connector, such that the bore axis of the weapon tube and the central axis 30 through the silencer 5 retain their identical position or alignment. The corresponding regulating or control signals in this case are obtained in a particularly simple manner, because both the gun 3 and the extension arms 14, 15 are pivoted about the same horizontal rotational axis 16.

If the gun 3 is aimed to the side, i.e., in azimuth, by rotating the turret 2, the corresponding sensor or aiming signals are again fed to the evaluation unit 28 and there they are processed into control signals for the adjustment members or drives 13. As a result, the parallel crank mechanism, which is defined essentially by the extension arms 14, 15 and the transverse member 19, ensures that in this case too, the bore axis and central axis 30 through the silencer 5 are aligned and retain their identical position after gun 3 completes its rotation.

In order to simultaneously adjust the height (elevation) and side movement (azimuth) of the silencer relative to the gun 3, the hinge or swivel joints 22–25 are configured as known multi-axis bearings, preferably, as a self-aligning pivot bearing.

A further embodiment is described below by way of FIGS. 2 and 3 in which the position of the weapon and the silencer gun carriage in the firing position not only have the same horizontal aiming axes but also the same rotational axes for side or azimuth adjustment. In this case, one prerequisite is that the trunnion axis of the gun or guns intersects the rotation axis of the turret at point 37.

Figure 2:
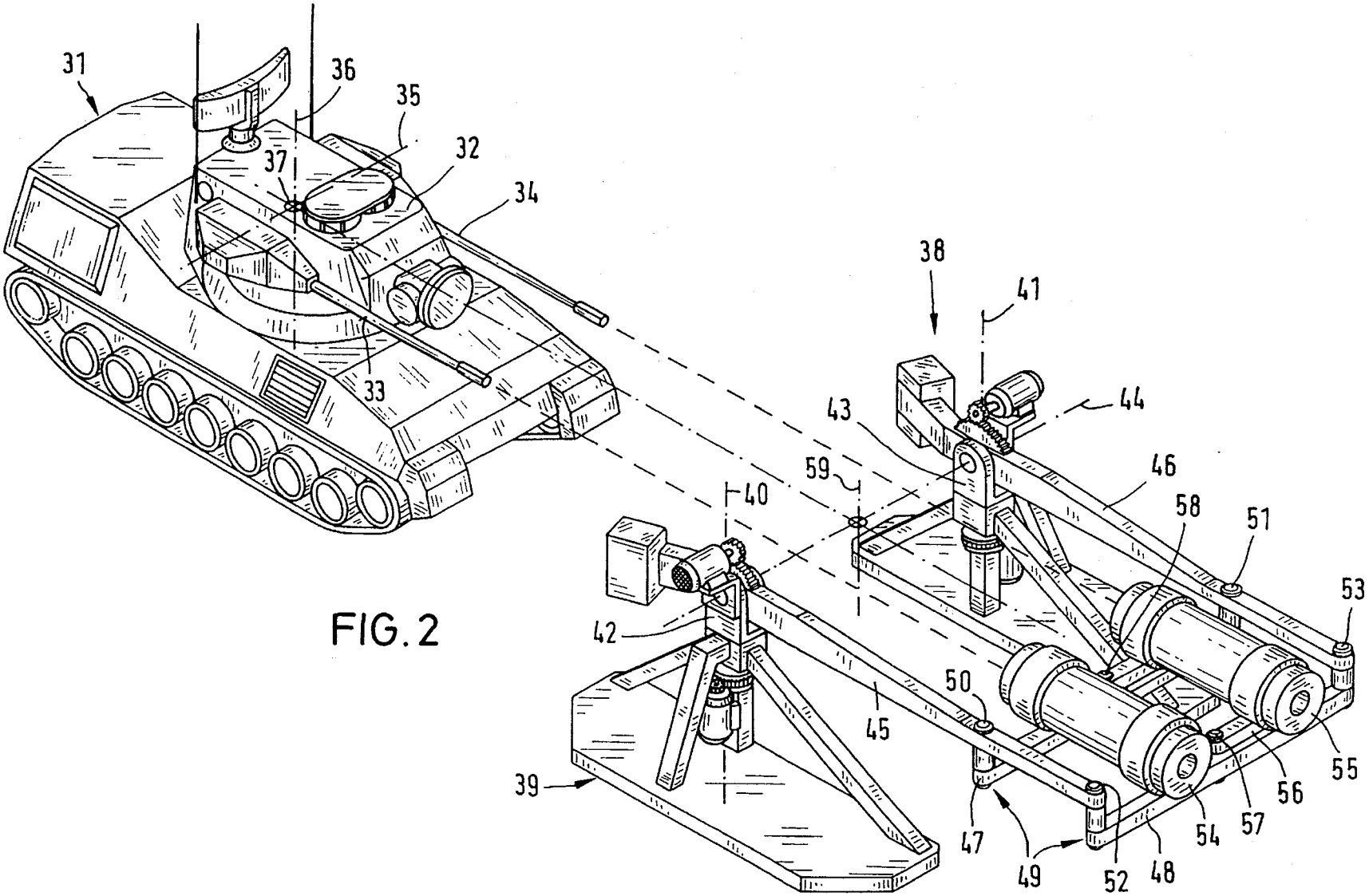
FIG. 2 is a perspective view of a second embodiment of a silencer arrangement according to the invention for an anti-aircraft tank having two guns, with the tank not yet having assumed its firing position.

FIG. 2 shows the situation prior to which a tank mount, denoted by 31, has assumed its firing position. The tank 31, which is an anti-aircraft tank, is provided with two guns 33, 34 on respective sides of the turret 32. The trunnion axis 35 for the guns 33, 34 in this case intersects the rotational axis 36 of the turret 2 at point 37.

The silencer arrangement denoted by 38 has in principal the same configuration as arrangement 4 described above in connection with FIG. 1. Particularly, the silencer gun carriage denoted by 39 comprises again two vertical mounting or bearing columns 42, 43, which are mounted for rotation about their respective longitudinal axes 40, 41, and at whose upper ends are two extension arms 45 and 46, respectively, which are arranged for rotation about the common horizontal axis 44. At their respective ends opposite the mounting columns 42, 43, the extension arms 45, 46 are again rotatably connected with a transverse member 49 comprising two generally parallel cross ties 47, 48, with the corresponding hinge or pivot joints being denoted by 50–53.

In contrast to FIG. 1, not one, but two silencers 54, 55, which are arranged parallel in relation to one another, are fastened to the silencer gun carrier 39 in order to dampen the noise formation of both guns 33,34. Both silencers 54, 55 are arranged on a silencer carrier 56 which itself is arranged centrally by way of hinge or swivel joints 57, 58 on the cross ties 47, 48 of the transverse member 49.

Further, in FIG. 2, 59 denotes a vertical axis which is located in the center between rotational axes 40 and 41.

Figure 3:
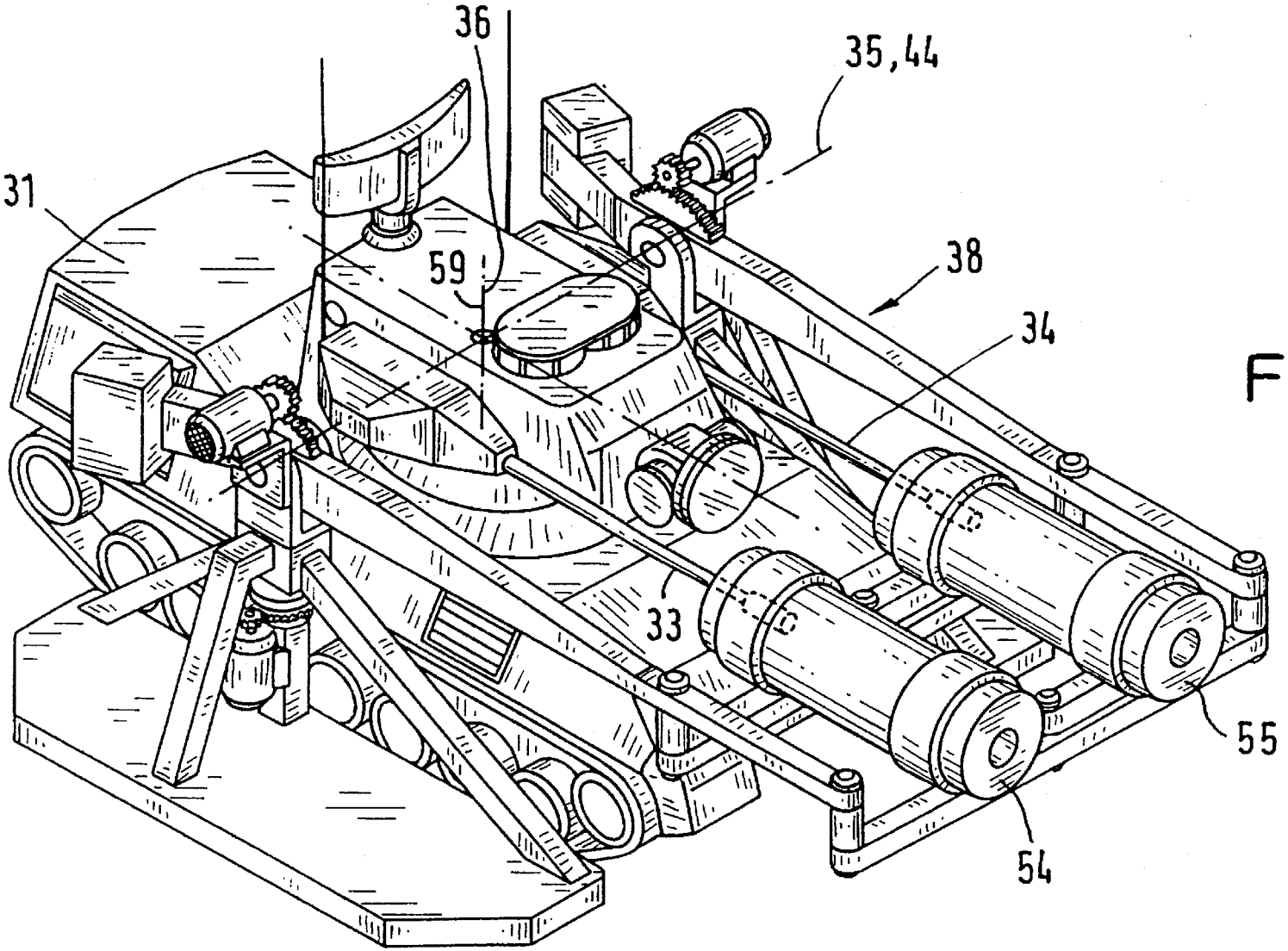
FIG. 3 is a perspective view of the silencer arrangement illustrated in FIG. 2, with the anti-aircraft tank being in its firing position.

FIG. 3 illustrates the case in which the anti-aircraft tank 31 is in the firing position and the two silencers 54, 55 thus enclose the muzzle ends of the guns 33, 34, respectively. In this case, the tank 31 was positioned in relation to the silencer arrangement 38 such that, with the height (elevation) and side (azimuth) positions of the guns 33, 34 set at 0°, the trunnion axis 35 of the weapon arrangement coincides with the horizontal rotational axis 44 of the carriage 39 and the vertical rotational axis 36 of the turret 32 is identical with the vertical axis 59 of the carriage 39. This association of guns 33, 34 and silencer gun carriage 39 may again occur by the movement of the tank 31 or by adjusting an adjustment device on the mounting columns 42, 43 of the silencer gun carriage 39. The actual control and/or alignment of the silencers 54, 55 in accordance with the position of the guns 33, 34 may, for example, as in the embodiment described with respect to FIG. 1, be accomplished with the help of sensors (not illustrated) or by scanning the aiming or directional signals of the gun aiming or directional control device in the tank.

The invention now being fully described, it will be apparent to one of ordinary skill in the art that any changes and modifications can be made thereto without departing from the spirit or scope of the invention as set forth herein.

What is claimed:

1. A silencer arrangement for a gun including at least one silencer for enclosing a muzzle end of a gun barrel, and a silencer gun carriage which is mechanically decoupled from the gun, with said silencer gun carriage comprising:

two mounting columns which are arranged vertically parallel to one another, and whose distance from one another is greater than the width of the gun mount which is to be arranged between said columns and whose gun is to be provided with said silencer, said mounting columns being mounted for pivotal movement about their respective vertical longitudinal axes;

a respective extension arm mounted, at a predetermined height, on each mounting column for rotation about a common horizontal axis of rotation;

at least one controllable drive member for rotating said two extension arms about said horizontal axis of rotation;

a transverse member connected between respective ends of said two extension arms facing away from said mounting columns via hinge joints; and further hinge joints for connecting said at least one silencer to said transverse member between said two extension arms.

2. A silencer arrangement according to claim 1 wherein there is one said silencer, and said hinge joints connect said silencer to said transverse member substantially in the center between said two extension arms.

3. A silencer arrangement according to claim 1, wherein said predetermined height at which said extension arms are pivotally arranged on the respective said mounting columns, and the distance between said horizontal rotational axis and said silencer fastened to said transverse member is such that when the gun is in its firing position and when its azimuth rotation is adjusted to 0°, a trunnion axis of the gun corresponds to said horizontal axis of rotation of said silencer gun carriage.

4. A silencer arrangement according to claim 1 wherein said transverse member includes two spaced parallel members, each connected between said two extension arms by said hinge joints so that said extension arms, said hinge joints and said transverse member form a parallel crank mechanism.

5. A silencer arrangement according to claim 1 wherein said hinge joints connecting said transverse member to said extension arms have multiple axes, whereby the elevation and azimuth positions of said silencer can be simultaneously adjusted.

6. A silencer arrangement according to claim 5, wherein said hinge joints having multiple axes are self-aligning bearings.

7. A silencer arrangement according to claim 1, further comprising means for controlling alignment of said silencer in accordance with the movement of the barrel of the gun including sensors provided on said silencer which check a central position of the gun barrel opening, and an evaluation unit connected to receive position signals from said sensors, and to provide control signals to said at least one drive member and to said adjustment members of said silencer gun carriage to properly position same.

8. A silencer arrangement according to claim 1, wherein: a weapons system including a horizontally spaced plurality of guns is to be used with said silencer arrangement; a respective silencer is provided for each of the plurality of guns; and, each silencer is connected by hinge joints with said transverse member of said silencer carriage between said two extension arms.

9. A silencer arrangement according to claim 8, said plurality of silencers are symmetrically disposed between said two extension arms.

* * * * *

UNITED STATES PATENT AND TRADEMARK OFFICE

CERTIFICATE OF CORRECTION

PATENT NO. : 5,461,962
DATED : October 31, 1995
INVENTOR(S) : Herbert KRUMM and Karl WIEMERS It is certified that error appears in the above-indentified patent and that said Letters Patent is hereby corrected as shown below:

On title page item [73] Assignee, the assignee's address should read: --Ratingen, Germany--.

Signed and Sealed this

Sixteenth Day of April, 1996

Bruce Lehman

*Attest:*

BRUCE LEHMAN

*Attesting Officer*

*Commissioner of Patents and Trademarks*